US007740238B2

(12) United States Patent
Iijima et al.

(10) Patent No.: US 7,740,238 B2
(45) Date of Patent: Jun. 22, 2010

(54) SHEET PROCESSING APPARATUS

(75) Inventors: Tomomi Iijima, Mishima (JP); Katsuhiko Tsuchiya, Numazu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 606 days.

(21) Appl. No.: 11/681,534

(22) Filed: Mar. 2, 2007

(65) Prior Publication Data

US 2008/0211159 A1 Sep. 4, 2008

(51) Int. Cl.
*B65H 37/04* (2006.01)

(52) U.S. Cl. ..... 270/37; 270/32; 270/45; 270/51; 270/58.07; 270/58.08; 270/58.09; 493/397; 493/399

(58) Field of Classification Search ..... 270/32, 270/37, 45, 51, 58.07, 58.08, 58.09; 493/397, 493/399, 415, 435
See application file for complete search history.

(56) References Cited

U.S. PATENT DOCUMENTS 4,338,085 A * 7/1982 Sullivan et al. ..... 493/254

FOREIGN PATENT DOCUMENTS

| | | |
|---|---|---|
| JP | 2004-231422 | 8/2004 |
| JP | 2004-284750 | 10/2004 |

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

A sheet processing apparatus according to the present invention including a saddle-stitcher configured to fold and discharge a sheet supplied from an image forming apparatus, and an assisting mechanism arranged in a sheet carrier path extending from the image forming apparatus to the saddle-stitcher and configured to form a folding line on the sheet in a first direction orthogonal to a direction of the carrying of the sheet in order to assist folding of the sheet. The assisting mechanism has a disc-shaped roller blade rotatably attached to a moving body that is movable in the first direction.

20 Claims, 6 Drawing Sheets

SHEET PROCESSING APPARATUS

BACKGROUND OF THE INVENTION

1. Field of the Invention

The present invention relates to a sheet processing apparatus that performs postprocessing on a sheet discharged from an image forming apparatus such as a copy machine, printer or multi-function peripheral (MFP).

2. Description of the Related Art

Recently, some of image forming apparatuses have a sheet postprocessing apparatus provided next to the image forming apparatus body in order to perform postprocessing such as sorting sheets after image formation and staple processing on sheets. There are also apparatuses that discharge a sheet bundle folded in two.

JP-A-2004-284750 discloses sheet postprocessing to bind sheets in a double-leaved form. In this example, a pair of folding rollers and a folding plate are provided, and sheets are pushed out to the pair of folding rollers by the folding plate, thus folding the sheets at their center. Also, before folding at the center, perforation forming means having multiple needles are pressed to the sheets and perforations are formed on the sheets.

Moreover, JP-A-2004-231422 discloses a sheet preparation system that drills or forms perforations on sheets. As the perforation forming means in this example, a rotary drilling wheel having a backer roll is applied, for example. However, its specific configuration is not described.

The two examples described above also have a problem that it is difficult to fold sheets when the sheets have a large thickness or the number of sheets is large in the case of forming perforations.

The present invention provides a sheet processing apparatus that has a finisher having a sheet folding mechanism and that is capable of forming a folding line such as perforations in advance in accordance with the need when folding sheets.

DETAILED DESCRIPTION OF THE INVENTION

Figure 1:
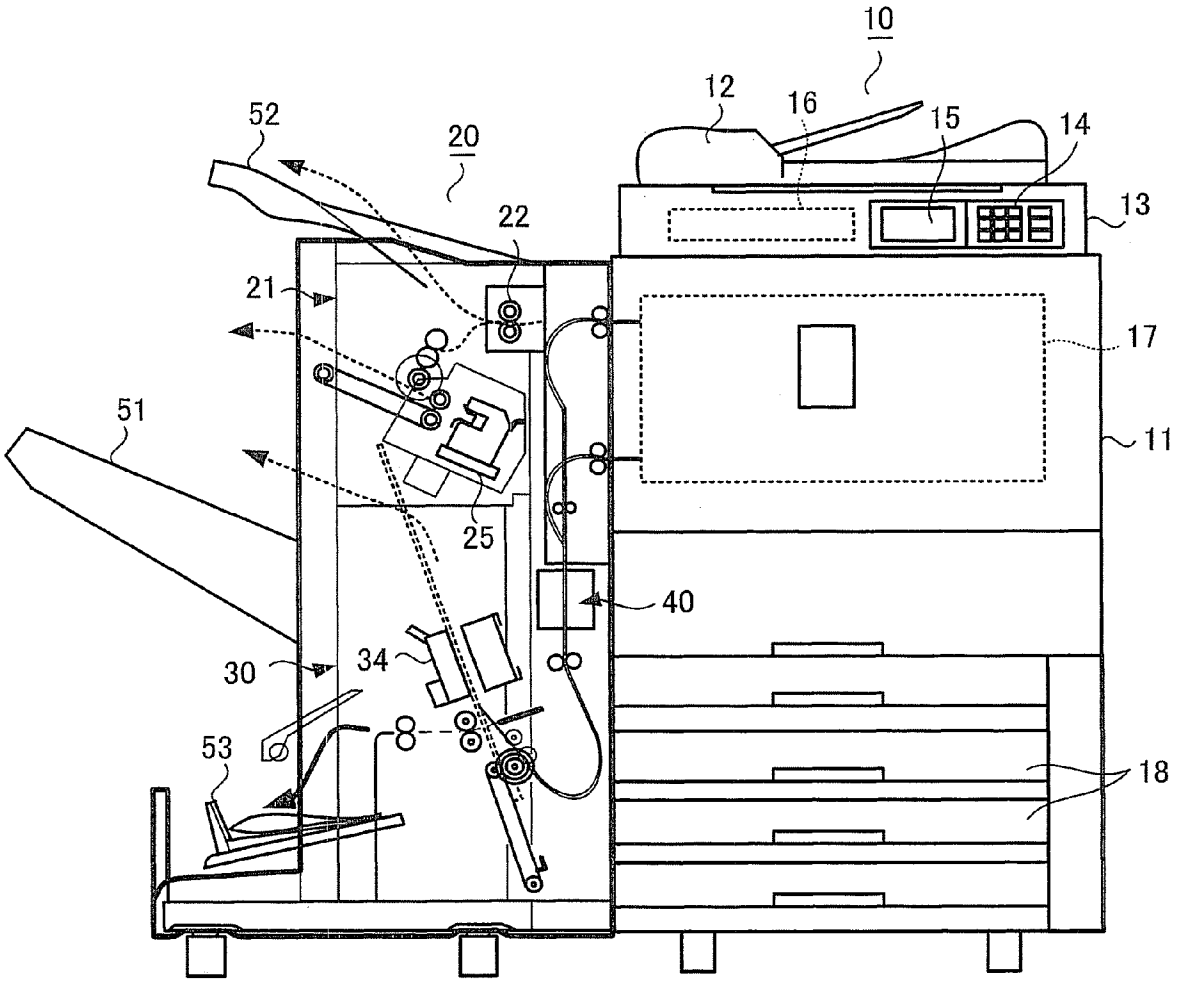
FIG. 1 is a schematic configuration view showing a sheet processing apparatus according to an embodiment of the invention.

Throughout this description, the embodiments and examples shown should be considered as exemplars, rather than limitations on the apparatus of the present invention.

Hereinafter, an embodiment of this invention will be described in detail with reference to the drawings. In the drawings, the same parts are denoted by the same numerals or symbols.

FIG. 1 is a configuration view showing an embodiment of a sheet processing apparatus of the invention. In FIG. 1, 10 denotes an image forming apparatus, for example, a multi-function peripheral (MFP), printer, or copy machine. A sheet processing apparatus 20 is arranged next to the image forming apparatus 10. A sheet on which an image is formed by the image forming apparatus 10 is carried to the sheet processing apparatus 20.

The sheet processing apparatus 20 performs postprocessing on the sheet supplied from the image forming apparatus 10, for example, sort processing and staple processing. It also folds the sheet in two, when necessary, and discharges it. Since the sheet processing apparatus 20 is generally called a finisher, it may be called the finisher 20 in the following description.

In FIG. 1, there is a document table (not shown) at the top of a body 11 of the image forming apparatus 10, and an automatic document feeder (ADF) 12 is provided to openable and closable over the original table. Moreover, an operation panel 13 is provided at the top of the body 11. The operation panel 13 has an operation unit 14 including various keys, and a touch-panel display unit 15.

A scanner unit 16 and a printer unit 17 are provided within the body 11. Moreover, plural cassettes 18 housing sheets of various sizes are provided in the lower part of the body 11. The scanner unit 16 reads a document fed by the ADF 12 or a document put on the document table.

The printer unit 17 includes a photoconductive drum, a laser and the like. The printer unit scans the surface of the photoconductive drum with a laser beam from the laser and thus exposes the surface, and creates an electrostatic latent image on the photoconductive drum. A charging unit, a developing unit, a transfer unit and the like are arranged around the photoconductive drum. The electrostatic latent image on the photoconductive drum is developed by the developing unit, and a toner image is formed on the photoconductive drum. The toner image is transferred to a sheet by the transfer unit. The configuration of the printer 17 is not limited to the above example and various systems may be applied.

The finisher 20 has a staple mechanism 21 that performs staple processing on a bundle of sheets, a saddle-stitcher 30 that performs sheet folding processing, a paper discharge tray 51, and a fixed tray 52. The paper discharge tray 51 is movable and receives a stapled bundle of sheets. The staple mechanism 21 also has an alignment device that aligns sheets carried thereto, in the direction of the width. The sheets can also be sorted and discharged with the use of this alignment device.

In the case where postprocessing such as stapling is not carried out, the sheets carried from the image forming apparatus 10 are discharged directly to the paper discharge tray 51 or the fixed tray 52 without any processing.

Figure 2:
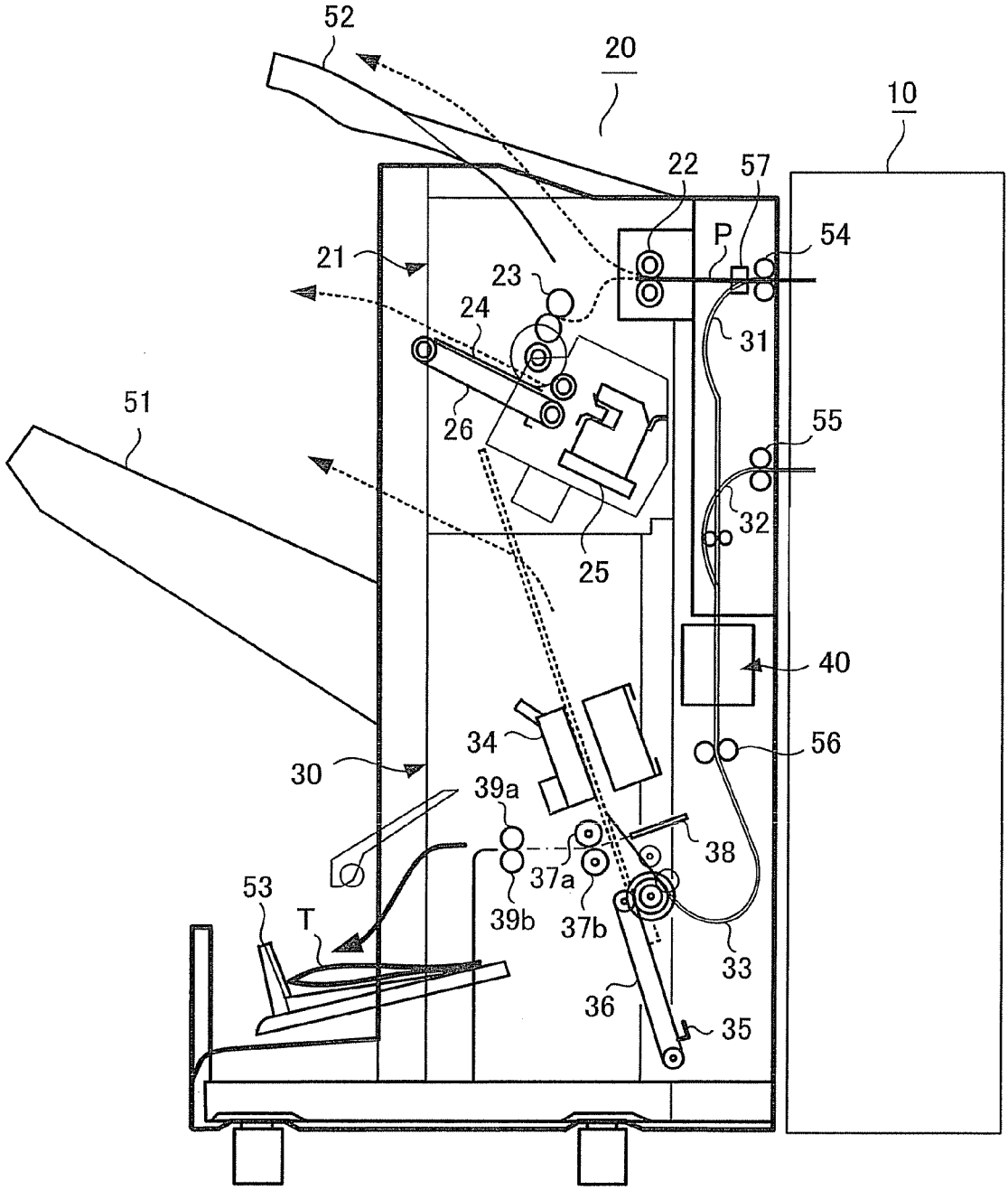
FIG. 2 is a configuration view showing an enlarged configuration of essential parts of the sheet processing apparatus of the invention.

The configuration of the finisher 20 is shown in an enlarged manner in FIG. 2. First, the staple mechanism 21 of the finisher 20 will be briefly described. A sheet P supplied from the image forming apparatus 10 is received by entry rollers 22 provided near an entry port of the finisher 20. Paper feed rollers 23 are provided downstream of the entry rollers 22. The sheet P received by the entry rollers 22 is loaded onto a processing tray 24 via the paper feed rollers 23 and the like.

The sheet loaded on the processing tray 24 is guided to a stapler 25 and staple processing is performed there. There is also provided a carrier belt 26 to carry the sheet P that has been sorted or stapled, to the paper discharge tray 51.

The sheet P carried by the carrier belt 26 is discharged to the paper discharge tray 51. The paper discharge tray 51 is lifted and lowered by a driving unit (not shown) and receives the sheet P.

Also, there is a case where the sheet P is discharged to the paper discharge tray 51 without being stapled. In this case, the sheet P is discharged without being dropped onto the processing tray 24. The sheet P that does not need postprocessing can also be discharged to the fixed tray 52. A carrier path is provided to guide the sheet P to the fixed tray 52, but it is not shown.

Next, the configuration of the saddle-stitcher 30 will be described.

The saddle-stitcher 30 is an apparatus that bundles plural sheets supplied from the image forming apparatus 10 and folds the bundle in two. In the present invention, before the sheets are carried to the saddle-stitcher 30, a folding line such as perforations is formed thereon in order to assist the folding of the sheets. An assisting mechanism 40 to form this folding line is provided.

The sheet P carried from the image forming apparatus 10 is fed to the assisting mechanism 40 via a paper path 31 or 32. The assisting mechanism 40 is to form a folding line at the center of the sheet P and in a direction orthogonal to the carrying direction. The details of the assisting mechanism 40 will be described later with reference to FIG. 4.

The sheet P passed through the assisting mechanism 40 is carried in the direction toward a stapler 34 via a paper path 33 and is temporarily received by a stack tray 35. The sheets P carried therein are sequentially stacked on the stack tray 35 into a bundle.

The bundle of sheets T on the stack tray 35 is carried in the direction to the stapler 34 by a guide belt 36. When the center part of the bundle of sheets T has reached the stapler 34, the guide belt 36 temporarily stops and the center part of the bundle of sheets T is stapled.

The bundle of sheets T stapled by the stapler 34 is lowered by the guide belt 36 and stops at a position where the center part of the bundle of sheets T comes to a nipping point of a pair of folding rollers 37*a*, 37*b*. A blade 38 is arranged at a position facing the pair of folding rollers 37*a*, 37*b*.

The blade 38 pushes the center part of the bundle of sheets T to the nipping point of the pair of folding rollers 37*a*, 37*b*, and pushes the bundle of sheets T in between the folding rollers 37*a* and 37*b*. After this, the pair of folding rollers 37*a*, 37*b* rotates while folding and nipping the bundle of sheets T, and thus folding the bundle of sheets T in two.

The bundle of sheets T, which has been folded in two, is carried by a pair of discharge rollers 39*a*, 39*b* and discharged to a paper discharge tray 53.

Also, in the case where the sheet P with a folding line formed thereon by the assisting mechanism 40 is to be discharged without being folded, it will be discharged directly to the paper discharge tray 51 without being stapled.

Guide rollers 54, 55 and 56 are provided in order to guide the sheet P supplied from the image forming apparatus 10 along the paper paths 31, 32 and 33. Also, a gate 57 is provided at the exit of the guide rollers 54 in order to switch the carrying of the sheet P supplied from the image forming apparatus 10 toward the staple mechanism 21 or toward the saddle-stitcher 30.

In the case where sheet folding processing is not to be carried out, the gate 57 carries the sheet P discharged from the image forming apparatus 10, to the rollers 22 of the staple mechanism 21. In the case where sheet folding processing is to be carried out, the gate carries the sheet P to the assisting mechanism 40.

Figure 3:
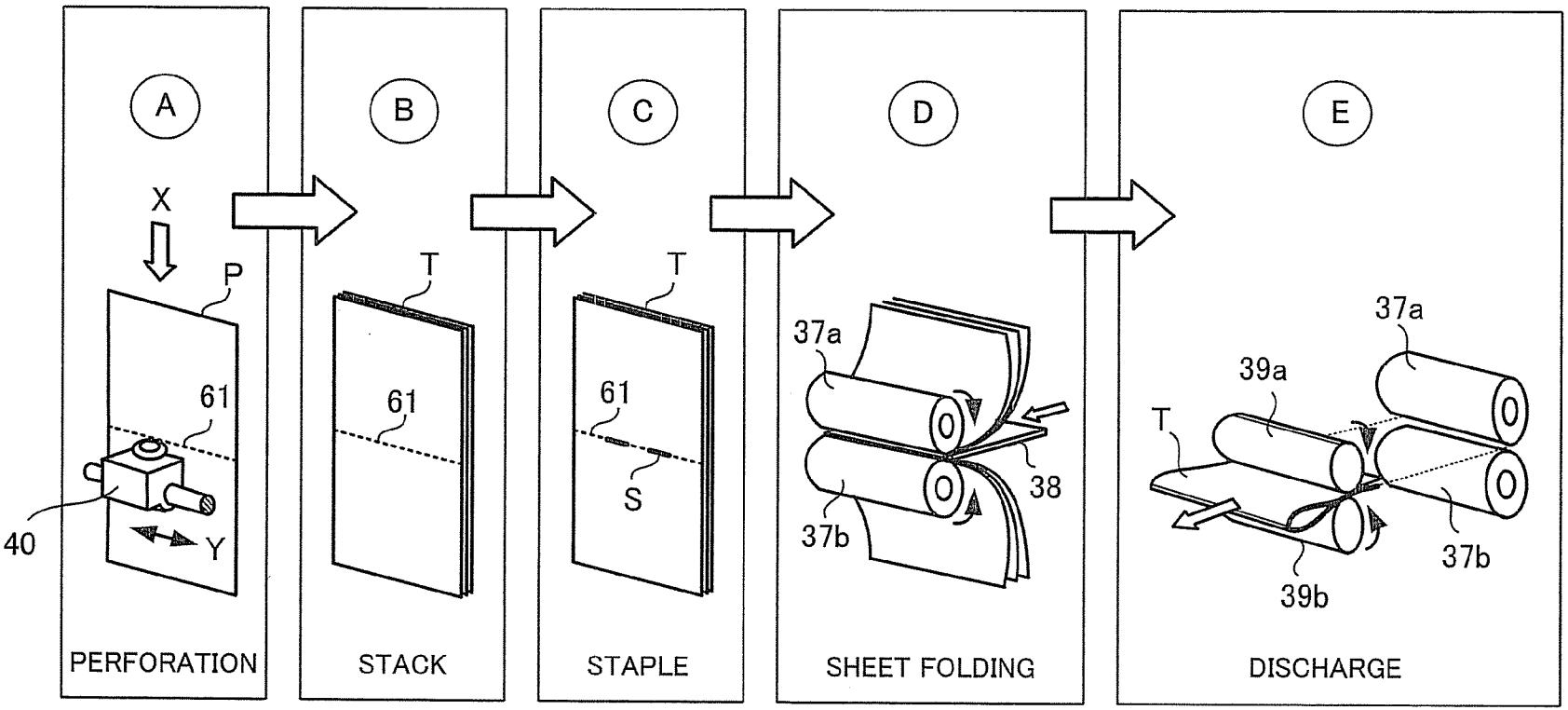
FIG. 3 is an explanatory view for explaining a flow of sheet folding processing in the sheet processing apparatus of the invention.

FIG. 3 is an explanatory view showing an operation flow of the saddle-stitcher 30. A sheet P is processed in the order indicated by A-E. In FIG. 3, on the sheet P carried from the image forming apparatus 10, a folding line 61 such as perforations is formed by the assisting mechanism 40 as indicated by A. The folding line 61 is formed at the center of the sheet P and in a Y-direction orthogonal to a direction X of carrying the sheet.

Next, the sheet P is carried via the paper path 33 and it is received by the stack tray 35 before being fed to the stapler 34. The sequentially carried sheets P are stacked on the stack tray 35 as indicated by B and they are aligned as a bundle of sheets T.

Next, the bundle of sheets T is carried to the stapler 34 by the guide belt 36, and when the center part of the bundle of sheets T has reached the stapler 34, the stapler 34 staples the center part of the bundle of sheets T. Staples S are placed on the folding line 61 as indicated by C.

After that, the bundle of sheets T on which the staples S have been placed is lowered by the guide belt 36. When the center part of the bundle of sheets T has reached the nipping point of the pair of folding rollers 37*a*, 37*b*, the blade 38 pushes the center part of the bundle of sheets T to the nipping point of the pair of folding rollers 37*a*, 37*b*, and pushes it in between the folding rollers 37*a* and 37*b*, as indicated by D. Then, as the pair of rollers 37*a*, 37*b* rotates to catch the bundle of sheets T into their in-between, the bundle of sheets T is folded and discharged.

The bundle of sheets T, which is folded in two, is carried by the pair of discharge rollers 39*a*, 39*b* as indicated by E and discharged to the paper discharge tray 53.

Figure 4:
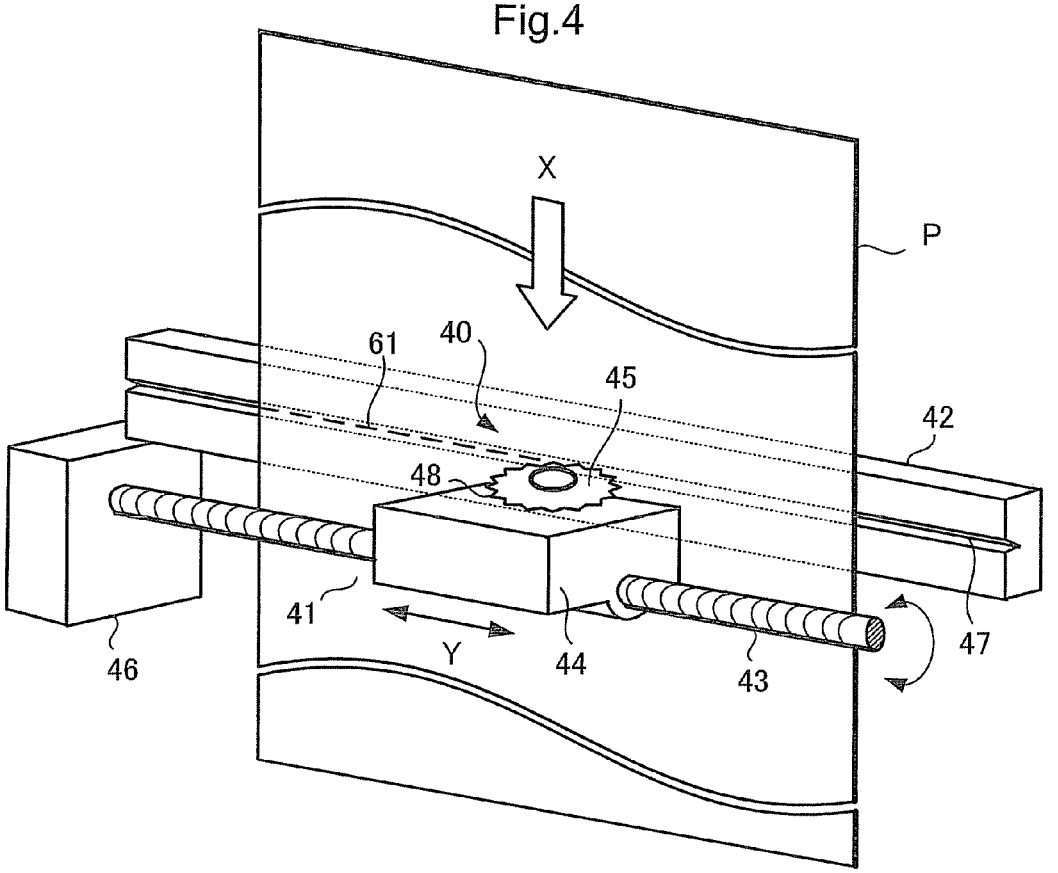
FIG. 4 is a perspective view showing an assisting mechanism used for the sheet processing apparatus of the invention.

FIG. 4 is a perspective view showing the configuration of the assisting mechanism 40. The assisting mechanism 40 includes a scratch unit 41 and a pad 42. The scratch unit 41 has a feed screw 43 arranged in the Y-direction orthogonal to the direction X of carrying the sheet P, a moving body 44 attached to this feed screw 43, and a roller blade 45 rotatably attached to the moving body 44.

The moving body 44 is moved in the Y-direction by the rotation of the feed screw 43. Also, a driving unit 46 to rotate the feed screw 43 is provided.

The pad 42 is arranged parallel to the direction of movement of the moving body 44, and a V-shaped slit 47 extending in the Y-direction is formed at a position facing the roller blade 45. The roller blade 45 rotates while being moved in the Y-direction by the feed screw 43. Thus, the folding line 61 is formed on the sheet P by the roller blade 45, and the slit 47 assists in forming the folding line 61.

If the depth of the slit 47 is too deep, the sheet P might be cut. Therefore, the slit 47 needs to be set at a depth that does not cause the sheet P to be cut. The circumferential surface of the roller blade 45 has, for example, a sawtooth notch 48. As the roller blade rotates while moving along the feed screw 43, a folding line 61 in the form of perforations is formed on the sheet P.

The feed screw 43 is used to move the moving body 44. However, the invention is not limited to the example with the feed screw 43, and a technique of attaching the moving body 44 to a belt laid in the Y-direction and moving the belt in the Y-direction may also be used. To move the belt, for example, a stepping motor is used.

Figure 5:
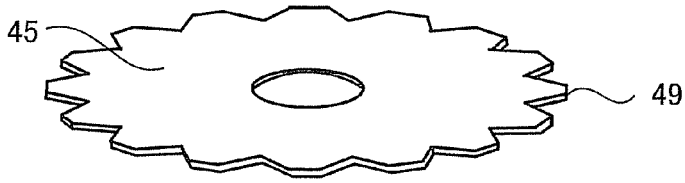
FIG. 5 is a perspective view showing a modification of the assisting mechanism of the invention.
Figure 6:
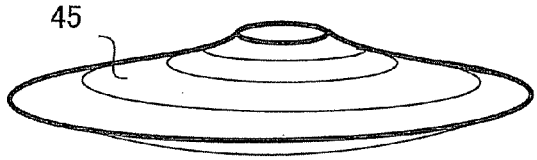
FIG. 6 is a perspective view showing another modification of the assisting mechanism of the invention.

FIG. 5 and FIG. 6 show modifications of the roller blade 45. In the example of FIG. 5, the circumferential surface of the roller blade 45 has a gear-like notch 49 and a folding line 61 in the form of a dotted line can be formed on the sheet P. In the example of FIG. 6, the roller blade 45 is disc-shaped and a linear folding line 61 can be formed on the sheet P.

Next, a control system of the sheet processing apparatus of the invention will be described with reference to FIG. 7.

Figure 7:
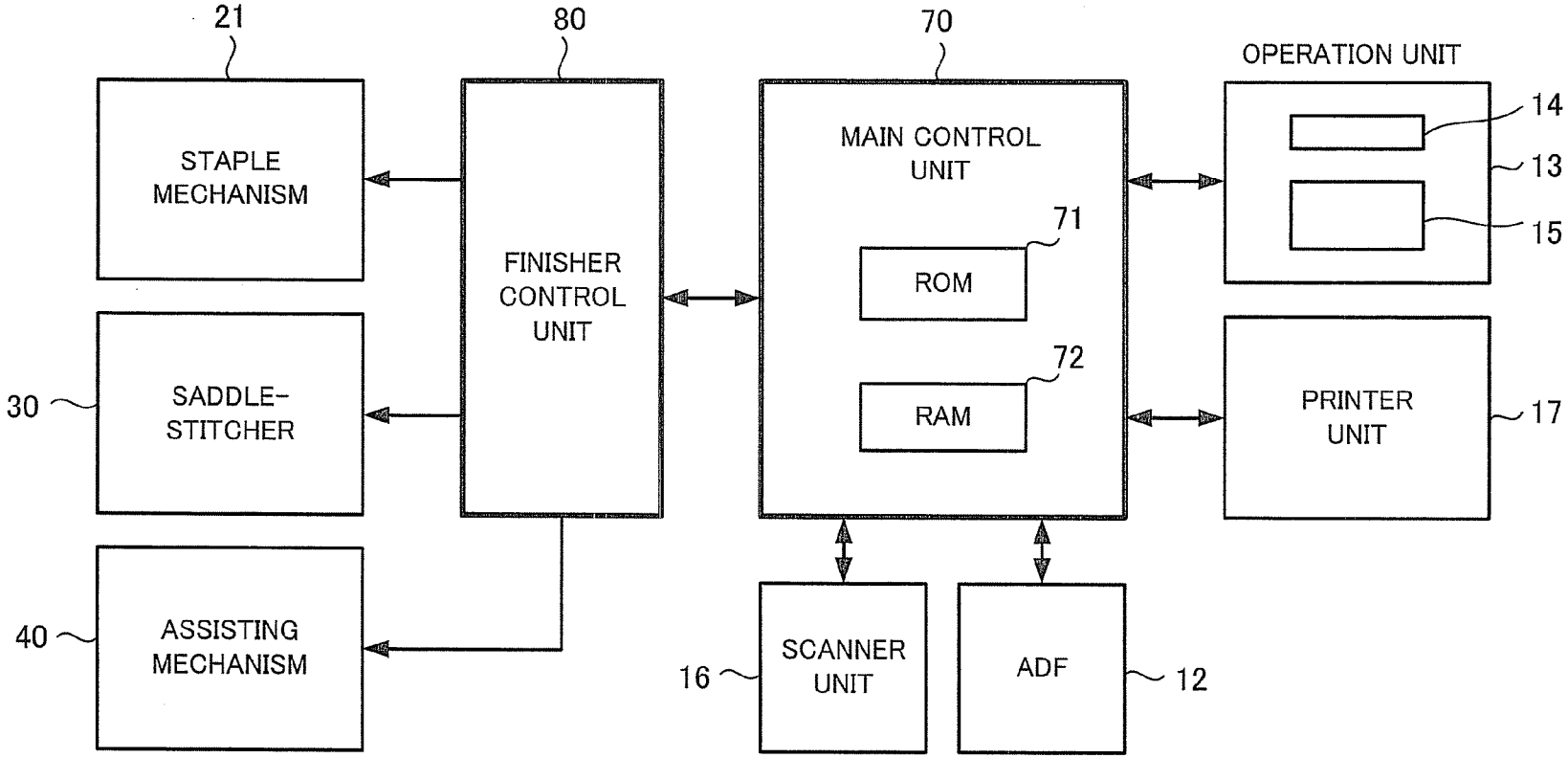
FIG. 7 is a block diagram showing a control system of the sheet processing apparatus of the invention.

In FIG. 7, a main control unit 70 has a CPU, a ROM 71, and a RAM 72, and controls the image forming apparatus 10 in accordance with a control program stored in the ROM 71. The main control unit 70 controls the operations of the ADF 12, the scanner unit 16 and the printer unit 17 in response to operations from the operation unit 13. The RAM 72 is used to temporarily store control data and for arithmetic processing at the time of control.

The operation unit 13 has the plural keys 14, and the display unit 15 that also serves as a touch panel. The operation unit can give various instructions for image formation. For example, an instruction about the number of copies is given with the use of the keys 14, and instructions about the sheet size, sheet type, and stapling, and an instruction of sheet folding and the like are given by the operation on the touch panel of the display unit 15.

Meanwhile, a finisher control unit 80 controls the operation of the finisher 20. The finisher control unit 80 is connected with the main control unit 70 and communicates information with the main control unit 70. The image forming apparatus 10 and the finisher 20 operate in cooperation therewith.

The finisher control unit 80 controls each of the staple mechanism 21, the saddle-stitcher 30, and the assisting mechanism 40. The controls of the staple mechanism 21 include implementation of stapling with the stapler 25, carrying of the sheet P to the stapler 25, discharge of the stapled sheet, and so on.

Also, the controls of the saddle-stitcher 30 include carrying out the sheet P via the paper path 33, movement and alignment of the bundle of sheets T with the guide belt 36, implementation of stapling with the stapler 34, pushing with the folding blade 38, and rotation control of the folding rollers 37*a*, 37*b* and the discharge rollers 39*a*, 39*b*.

Moreover, the controls of the assisting mechanism 40 include carrying of the sheet P to the assisting mechanism 40, movement control of the moving body 44 by the driving unit 46, and so on.

Figure 8A:
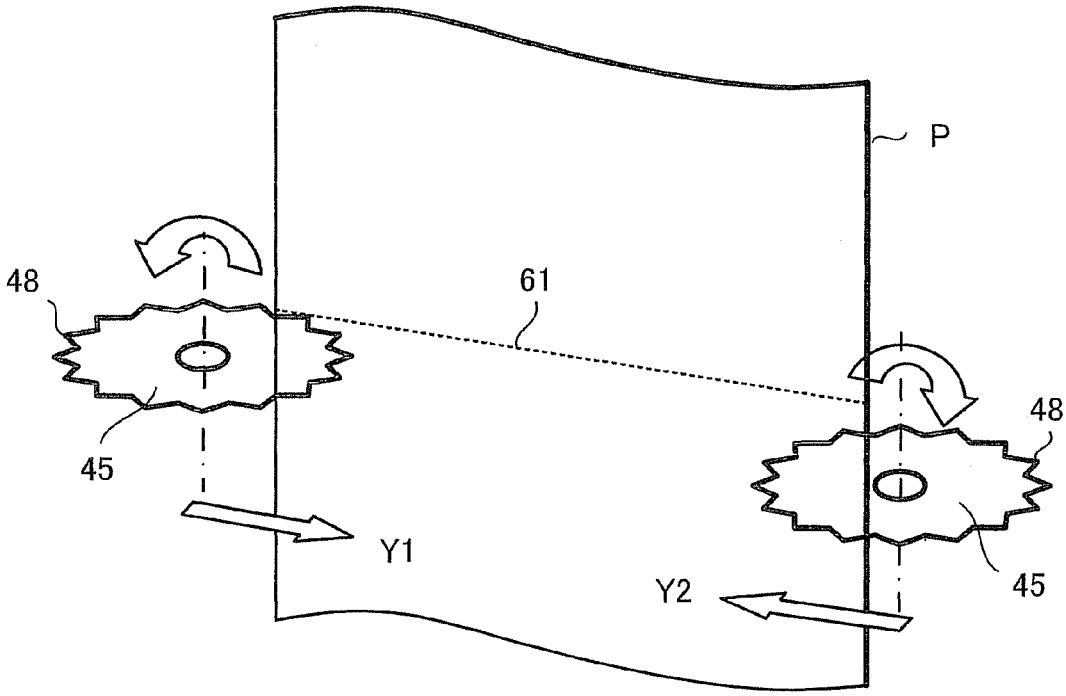
FIG. 8A and FIG. 8B are explanatory views showing other embodiments of the assisting mechanism of the invention.
Figure 8B:
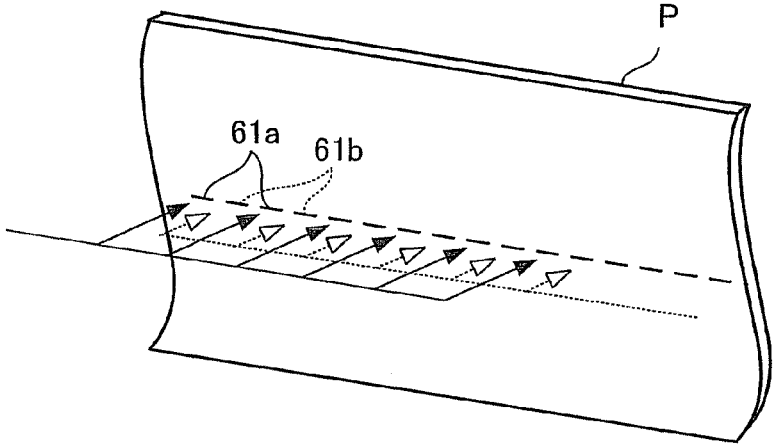

FIG. 8A and FIG. 8B are explanatory views showing exemplary ways of forming the folding line 61 by the assisting mechanism 40. FIG. 8A shows the case where the circumferential surface of the roller blade 45 has the sawtooth notch 48.

As shown in FIG. 8A, the roller blade 45 reciprocates in a first direction Y1 and a second direction Y2 along the feed screw 43. Usually, the perforations 61 are formed on the first sheet P as the roller blade moves in the first direction Y1, and the perforations 61 are formed on the second sheet P as the roller blade moves in the second direction Y2.

Meanwhile, in some cases where a thick sheet or the like is used, perforations cannot be sufficiently formed by a forward movement or backward movement alone. In such cases, the roller blade 45 may be reciprocated on a single sheet P and the perforations 61 can be formed by each of its forward movement and backward movement. In this case, the roller blade 45 can be moved in one direction or in both directions in accordance with the type of the sheet P (whether it is thick or thin).

Also, if the positions of perforations 61*a* formed by the movement of the roller blade 45 in the first direction Y1 and perforations 61*b* formed by the movement in the second direction Y2 are shifted by half cycle, as shown in FIG. 8B, the spacing between the perforations can be made smaller. Thus, sufficient perforations 61 can be formed even on a thick sheet.

Next, several specific examples of how to form the folding line 61 on the sheet P will be described. For example, the following cases can be considered with respect to the way of forming the folding line 61.

a. A folding line is formed on each of carried sheets.

b. A folding line is formed only when the carried sheet is thick. For example, in the case where a sheet to serve as the cover sheet is thick when a bundle of sheets is folded in two, a folding line is formed only on the cover sheet.

For the thickness of a sheet, for example, a sensor that detects the thickness of a sheet may be provided in the assisting mechanism 40, and a folding line can be formed in the case where a sheet having a predetermined thickness or more is carried thereto. Alternatively, the operation unit 13 may be operated to input the type of a sheet and the thickness of the sheet may be determined in accordance with the type of the sheet.

c. In the case where the bundle of sheets T has a large number of sheets, a folding line is formed only on plural sheets close to the cover sheet.

For the number of sheets of the bundle of sheets T, the number of sheets at the time of folding processing may be inputted by the operation of the keys 14 of the operation unit 13, and a folding line can be formed only on sheets exceeding a preset number of sheets.

d. No folding line is formed on the first page and the last page of the bundle of sheets T.

In this case, since the total number of sheets can be understood as the number of sheets at the time of folding processing is inputted by the operation of the keys 14 of the operation unit 13, the first page and the last page of them may be discharged without any folding line.

Also, there may be a case where the folding line 61 is to be formed on the sheet P, which is then to be discharged without being folded. In this case, the sheet can be discharged to the paper discharge tray 51 while the folding processing and the staple processing by the stapler 34 are omitted.

Moreover, the position where the assisting mechanism 40 is provided, is not limited to the position shown in the drawing, and it may be any position on the way from the image forming apparatus 10 up to a position before the saddle-stitcher 30.

As described above, according to the invention, the folding processing for the bundle of sheets T is made easier since the folding line 61 such as perforations is formed on the carried sheet P. Also, the bulge after folding the sheets is reduced and the amount of stacks on the paper discharge tray can be increased.

The invention is not limited to the above description and various modifications can be made without departing from the scope of the claims.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet processing apparatus that processes a sheet supplied from an image forming apparatus, comprising:

A saddle folding unit configured to fold and discharge the sheet supplied from the image forming apparatus; and an assisting mechanism arranged in a sheet carrier path extending from the image forming apparatus to the saddle folding unit and configured to form a folding line on the sheet in a first direction orthogonal to a direction of the carrying of the sheet in order to assist folding of the sheet;

wherein the assisting mechanism having a moving body movable in the first direction, and a disc-shaped roller blade has a saw-tooth notch on the outer circumferential surface rotatably attached to the moving body and configured to form the folding line on the sheet.

2. The sheet processing apparatus according to claim 1, wherein the assisting mechanism forms a folding line in the form of perforations in the first direction in a manner of crossing a center part of the sheet passing through the carrier path.

3. The sheet processing apparatus according to claim 1, wherein the assisting mechanism includes a driving unit configured to drive the moving body in the first direction.

4. The sheet processing apparatus according to claim 1, wherein the assisting mechanism has a pad arranged parallel to the direction of movement of the moving body, and moves the moving body while pushing the sheet to the pad by the roller blade.

5. The sheet processing apparatus according to claim 1, wherein the saddle folding unit folds the sheet along the folding line formed on the sheet.

6. The sheet processing apparatus according to claim 1, wherein the saddle folding unit further includes a stapler, bundles plural sheets including the sheet with the folding line formed thereon, carries out staple processing thereon, and folds the stapled bundle of sheets.

7. The sheet processing apparatus according to claim 6, wherein the saddle folding unit carries out the staple processing along the folding line.

8. A sheet processing apparatus that processes a sheet supplied from an image forming apparatus, comprising:

a saddle folding unit configured to fold and discharge the sheet supplied from the image forming apparatus; and an assisting mechanism arranged in a sheet carrier path extending from the image forming apparatus to the saddle folding unit and configured to form a folding line on the sheet in a first direction orthogonal to a direction of the carrying of the sheet in order to assist folding of the sheet, the assisting mechanism has a pad arranged parallel to the direction of movement of the moving body, and moves the moving body while pushing the sheet to the pad by the roller blade, wherein the pad has a V-shaped groove at a position facing the circumferential surface of the roller blade along the first direction.

9. The sheet processing apparatus according to claim 8, wherein the saddle folding unit folds the sheet along the folding line formed on the sheet.

10. The sheet processing apparatus according to claim 8, wherein the saddle folding unit further includes a stapler and bundles plural sheets including the sheet with the folding line formed thereon, caries out staple processing thereon, and folds the stapled bundle of sheets.

11. The sheet processing apparatus according to claim 8, wherein the saddle folding unit carries out the staple processing along the folding line.

12. A sheet processing apparatus comprising:

a saddle folding unit configured to fold and discharge the sheet supplied form the image forming apparatus;

an assisting mechanism arranged in a sheet carrier oath extending from the image forming apparatus to the saddle folding unit and configured to be able to form a folding line on the sheet in a first direction orthogonal to a direction of the carrying of the sheet in order to assist folding of the sheet;

a control unit configured to control operation of the assisting mechanism in accordance with the number of the sheets;

wherein the saddle folding unit can bundle plural sheets and fold them, and the control unit controls the assisting mechanism, and forms the folding line on a predetermined number of sheets in the case where the number of sheets forming the bundle of sheets exceeds a present number of sheets.

13. The sheet processing apparatus according to claim 12, wherein the assisting mechanism having a moving body movable in the first direction, and a disc-shaped roller blade rotatably attached to the moving body and configured to form the folding line on the sheet, and the control unit controls the assisting mechanism and moves the roller blade in one direction or in forward and backward directions along the first direction, thus forming the folding line.

14. The sheet processing apparatus according to claim 12, wherein the control unit controls the assisting mechanism and forms the folding line on the sheet having a predetermined thickness or more.

15. A sheet processing apparatus that processes a sheet supplied from an image forming apparatus, comprising:

a saddle folding unit configured to fold and discharge the sheet supplied from the image forming apparatus;

an assisting mechanism arranged in a sheet carrier path extending from the image forming apparatus to the saddle folding unit and configured to be able to form a folding line on the sheet in a first direction orthogonal to a direction of the carrying of the sheet in order to assist folding of the sheet; and a control unit configured to control operation of the assisting mechanism in accordance with page of the sheets, wherein the saddle folding unit can bundle plural sheets and fold them, and the control unit controls the assisting mechanism and forms the folding line on the sheets other than a first page and a last page forming the bundle of sheets.

16. The sheet processing apparatus according to claim 15, wherein the control unit controls the assisting mechanism and forms the folding line on the sheet having a predetermined thickness or more.

17. The sheet processing apparatus according to claim 15, wherein the assisting mechanism has a moving body movable in the first direction, and a disc-shaped roller blade rotatably attached to the moving body and configured to form the folding line on the sheet, and the control unit controls the assisting mechanism and moves the roller blade in one direction or in forward and backward directions along the first direction, thus forming the folding line.

18. A sheet processing apparatus that processes a sheet supplied from an image forming apparatus, comprising:

a saddle folding unit configured to fold and discharge the sheet supplied from the image forming apparatus;

an assisting mechanism arranged in a sheet carrier path extending from the image forming apparatus to the saddle folding unit and configured to be able to form a folding line on the sheet in a first direction orthogonal to a direction of the carrying of the sheet in order to assist folding of the sheet;

a first control unit configured to control operation of the assisting mechanism; and a second control unit configured to control the saddle folding unit, wherein the second control unit performs control in order to discharge the sheet on which the folding line is formed by the assisting mechanism, without performing the folding processing, in accordance with the need.

19. The sheet processing apparatus according to claim 18, wherein the first control unit controls the assisting mechanism and forms the folding line on the sheet having a predetermined thickness or more.

20. The sheet processing apparatus according to claim 18, wherein the assisting mechanism has a moving body movable in the first direction, and a disc-shaped roller blade rotatably attached to the moving body and configured to form the folding line on the sheet, and the first control unit controls the assisting mechanism and moves the roller blade in one direction or in forward and backward directions along the first direction, thus forming the folding line.

* * * * *